United States Patent [19]

Keeton

[11] 4,232,621

[45] Nov. 11, 1980

[54] METAL-WORKING HAND TOOL

[76] Inventor: John H. Keeton, P.O. Box 278, Campbellsville, Ky. 42718

[21] Appl. No.: 875,544

[22] Filed: Feb. 6, 1978

[51] Int. Cl.[2] ..... B21D 19/00

[52] U.S. Cl. ..... 113/54 R; 113/58

[58] Field of Search ..... 113/54, 55, 57, 58; 72/76; 272/37 R, 39, 285

[56] References Cited

U.S. PATENT DOCUMENTS

| | | | |
|---|---|---|---|
| 1,360,071 | 11/1920 | Alseth | 272/33R |
| 2,017,099 | 10/1935 | Kuzel | 272/39 |
| 2,998,738 | 9/1961 | Crine, Sr. | 113/54 |
| 3,015,293 | 1/1962 | Parham | 113/54 |
| 3,195,492 | 7/1965 | Erickson | 113/54 |
| 3,487,669 | 1/1970 | Kemp | 113/54 |

*Primary Examiner*—Leon Gilden

*Attorney, Agent, or Firm*—Cushman, Darby & Cushman

[57] ABSTRACT

A metal-working hand tool for folding over sheet metal flanges is provided that effect folding over without harming the flange surface. The tool includes a body adapted to rotate about a first axis, a structure for attaching the body to a power source for rotating the body about the first axis, a guide component extending outwardly from one end of the body along the first axis, a plurality of hardened metal rollers, and a shaft associated with each roller for mounting each roller for free rotation about a second axis fixed with respect to the body so that the rollers will impact upon and roll with respect to a sheet metal flange. In use, the metal flange of the metal joint to be closed is disposed generally vertically, the power source is energized to rotate the body, the guide component is disposed so that it is in a direction generally parallel to the flange, and the guide component is moved into contact with a side of the joint while moving the tool generally horizontally along the direction of elongation of the flange so that the rollers impact upon and roll with respect to the flange to deform it so that it extends generally horizontally.

10 Claims, 3 Drawing Figures

Fig. 1.
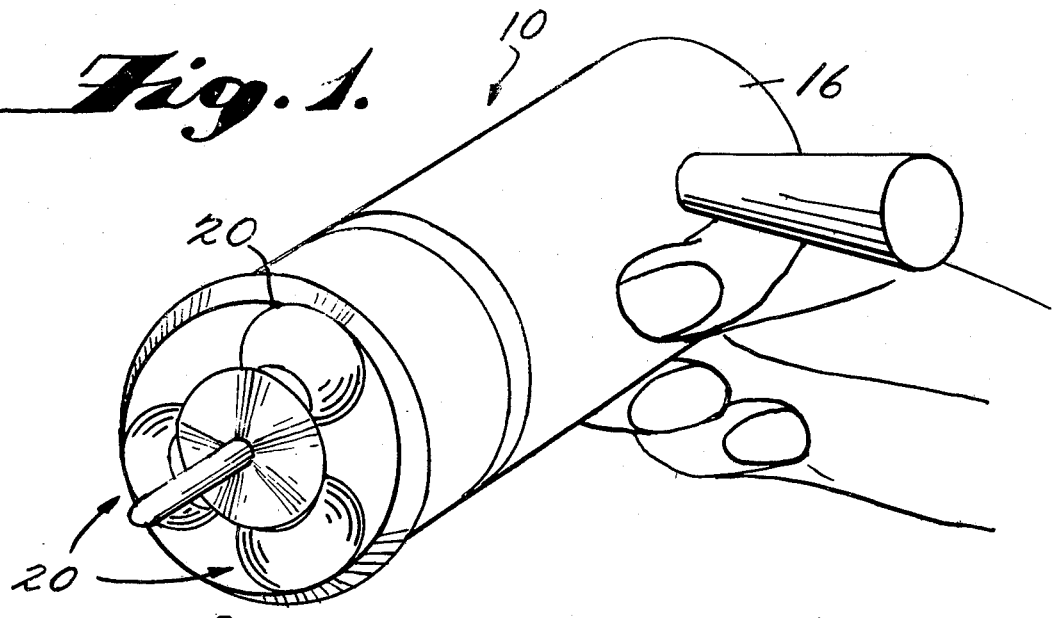
Fig. 3.
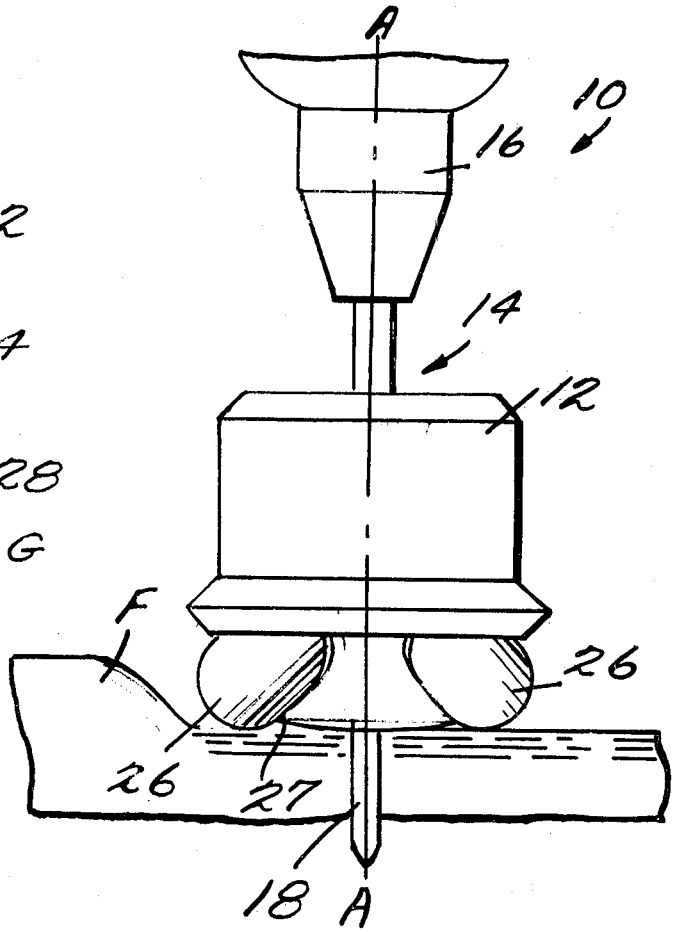
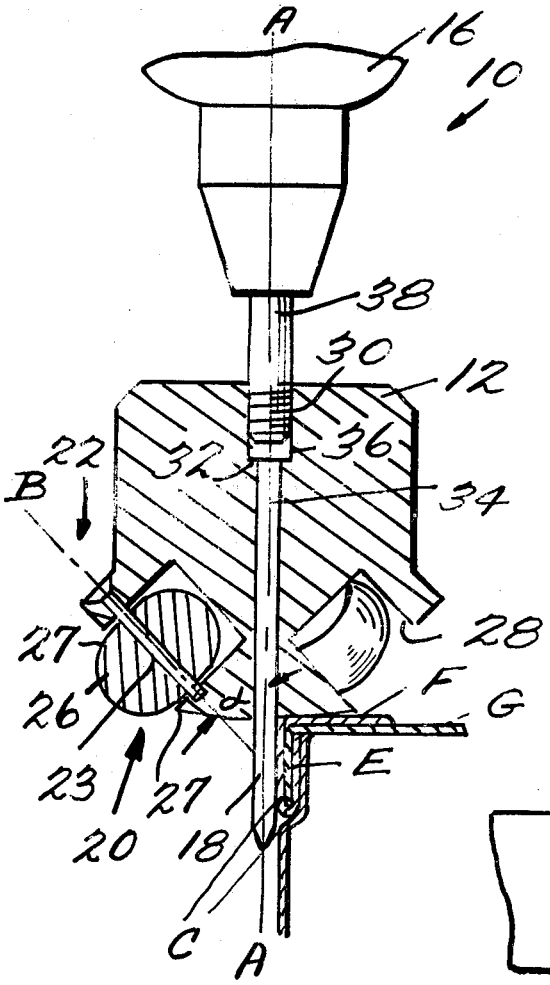
Fig. 2.

METAL-WORKING HAND TOOL

BACKGROUND AND SUMMARY OF THE INVENTION

In small shops and especially for light duct work, it is desirable to utilize a hand power tool that is useful for closing sheet metal joints, such as those commonly known in the trade as "pittsburgh locks". In the past there have been many proposals, and several commerical structures, for effecting such results, such as shown in U.S. Pat. Nos. 3,195,492 and 3,487,669. While such structures can accomplish their intended results, despite efforts to the contrary, they often result in damage to the surface of the sheet metal flanges being deformed, and can be especially damaging to painted surfaces. Also, such structures may be difficult to operate, especially where the metal is anything besides the lightest gauge, and where unskilled laborers are expected to operate the structures.

According to the present invention, a metal-working hand tool is provided for closing pittsburgh locks and the like that is able to effectively fold over sheet metal flanges of a wide variety of gauges normally encountered in the field, yet can effect such results without any damage at all to the metal flange surfaces being folded over, even if the surfaces are painted. The hand tool according to the invention is utilizable in a simplified method of effecting the flange deformation that is fail-safe in use, and makes the structure properly operable by even unskilled laborers.

According to the present invention, a metal-working hand tool is provided for folding over sheet metal flanges that includes a body adapted to rotate about a first axis, means for attaching the body to a power source for rotating the body about the first axis, and a guide component extending outwardly from one end of the body generally along the first axis. A plurality of hardened metal roller means are mounted to the body for free rotation about second axes, fixed with respect to the body, so that the roller means will impact upon and roll with respect to a sheet metal flange or the like. While such action is very sure in effecting flange deformation, the relative rolling that takes place between the roller means and the work prevents damage to the surface of the work.

The roller means mounting means according to the invention, preferably comprises a shaft for each roller means disposed so that each second axis makes a positive angle $\alpha$ between 0° and 90° with respect to the first axis, the angle $\alpha$ preferably being about 35° to 55°. The shafts are disposed along lines converging at the interface between the guide component and the body, and each shaft may include a dowel pin that is releasably attached to the body. The roller means preferably each comprise a tapered roller having flattened end portions received within a cavity defined in the body and having a peripheral portion extending exteriorly of the body, preferably three rollers being provided disposed at the apices of an equilateral triangle, around the circumference of the body. The attaching means may comprise means defining a screw-threaded bore concentric with the first axis in the body and opposite the guide component, and the guide component may comprise a guide pin having a head portion abutting an axial termination of the screw-threaded bore.

Utilizing the hand tool according to the present invention, a simplified method of deforming an upturned sheet metal elongated flange of a metal joint to close the joint is provided. The method includes the steps of disposing the metal joint so that the metal flange extends generally vertically, effecting energization of the tool to rotate the body, disposing the guide components so that it is in a direction generally parallel to the metal flange, and moving the guide component into contact with a side of the joint (for guiding movement) while moving the tool generally horizontally along the direction of elongation of the flange, to deform it so that it extends generally horizontally. Practicing such a method, it is possible for even unskilled laborers to acurately and quickly effect joint closing without damage to the work.

It is the primary object of the present invention to provide an improved hand tool and method for folding over sheet metal flanges. This and other objects of the invention will become clear from an inspection of the detailed description of the invention, and from the appended claims.

BRIEF DESCRIPTION OF THE DRAWINGS

FIG. 1 is a perspective view of an exemplary hand tool according to the present invention;

FIG. 2 is a fragmentary view partly in section and partly in elevation showing the tool in use for folding over a sheet metal flange; and FIG. 3 is a fragmentary front elevation view showing an exemplary hammer according to the invention folding over a metal flange.

DETAILED DESCRIPTION OF THE DRAWINGS

In the specification and claims, the terms "vertical" and "horizontal" when used are merely for references purposes, and the invention is to be construed so as not be limited to location of component parts in absolute vertical or horizontal positions; rather it is the relative position between component parts that is important.

An exemplary metal-working hand tool according to the present invention for folding over sheet metal flanges F is shown generally at 10 in the drawings. The tool 10 includes a body 12 adapted to rotate about a first axis of rotation A—A, means 14 for attaching the body 12 to a power source 16 (such as a conventional hand rotary drill) for rotating the body 12 about the axis A—A, a guide component 18 extending outwardly from one end of the body 12 generally along the axis A—A, a plurality of hardened metal roller means 20, and means 22 (see FIG. 2) for mounting the roller means 20 to the body 12 for free rotation about second axes B—B, fixed with respect to the body 12, so that the roller means 20 will impact upon and roll with respect to a sheet metal flange F or the like.

The roller means mounting means 22 preferably comprise a shaft—such as a dowel pin 23 for each roller means 20, disposed so that each said second axis B—B makes a positive angle $\alpha$ (see FIG. a) between 0° and 90° with respect to the axis A—A. The angle $\alpha$ will be chosen based upon convenience of construction of the device, ability to perform the desired impacting function, and for safety purposes. By proper selection of the angle $\alpha$, any chance for any protruding components to harm an operator's hand are essentially eliminated. The angle $\alpha$ preferably is chosen so that it is between about 35° and 55°. With an angle $\alpha$ of 45°, the structure operates properly, and is relatively easy to construct since 45° angle bores are relatively easy to form. An exemplary device according to the invention has been constructed with an angle $\alpha$ of 52°, which structure was emminently safe and was capable of operating to perform the desired impacting functions without damage to the work. Preferably, the dowel pins 23 are readily releasable (i.e. screw-threaded in place) so that the rollers 20 may be replaced if desired. The shafts 23 are disposed along lines B—B which converge at the interface 24 between the guide component 18 and the body 12.

The roller means 20 preferably comprise three tapered rollers 26 disposed at the apices of an equilaterial triangle, around the circumference of the body 12 (see FIG. 1 in particular), each tapered roller 26 having flattened end portions 27 (see FIG. 2) received within a depression 28 defined in the body 12, and having a peripheral portion always extending exteriorly of the body 12, although the peripheral portion that is exterior of the body 12 will change due to the free rotation of the rollers 26.

The attaching means 14 may be selected from a wide variety of conventional devices. A preferred attaching means 14 is shown in detail in FIG. 2, the means 14 comprising means 30 defining a screw-threaded bore concentric with the first axis A—A in the body and opposite the guide component 18. The guide component 18 preferably comprises a guide pin 34, the guide pin 34 having a head portion 36 that abuts the axial termination 32 of the screwthreaded bore 30. A threaded rod 38 that is releasably attachable to a rotary power source 16, such as a conventional hand drill, is screwed into the threaded bore 30, effecting attachment of the body 12 to the power source 16.

A tool 10 according to the present invention is shown in operative stages in FIGS. 2 and 3. Normally, the metal joint to be closed utilizing the tool 10 according to the present invention is a pittsburgh lock having a flange F that is originally upstanding from a cavity defining portions C of the same piece of sheet metal. A downturned flange E of a sheet G is placed between the cavity defining components C, and then the metal joint is disposed so that the flange F extends generally vertically. The power source 16 is energized, as by depressing the control trigger thereof, and the guide component 18 is disposed—as shown in FIGS. 2 and 3—so that it extends in a direction generally parallel to the vertical flange F, and thus the axis A—A is disposed generally parallel to the upstanding flange F. As illustrated in FIG. 2, normally the axis A—A will not be exactly vertical, but the body 12 will be cocked slightly outwardly from the flange F. The method according to the invention comprises the first step of moving the guide component 18 into contact with a side of the joint while moving the tool 10 generally horizontally along the direction of elongation of the flange, so that the roller means 20 impact upon and roll with respect to the flange F to deform it so that it extends generally horizontally, as shown in FIG. 2. The right-hand portion of FIG. 3 shows the flange F being bent over into joint closing position (as in FIG. 2), while the left-hand portion of FIG. 3 shows the flange F being bent over by the roller means 20, and also upstanding portions F thereof.

Because of the provision of the guide component 18 and the orientation of the axis of rotation of the body 12, even an unskilled laborer can properly operate the tool 10 to effect the desired results. The rollers 26 are formed of tempered steel and are preferably highly polished, which contributes to the efficient impacting and the minimization of harm to the surface of the sheet metal being formed that is characteristic of the present invention.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompassed all equivalent structures and methods.

I claim:

1. A metal-working hand tool for folding over sheet metal flanges, comprising a body adapted to rotate about a first axis of rotation, means for attaching said body to a power source for rotating said body about the first axis of rotation, a guide component extending outwardly from one end of said body generally along the first axis of rotation, a plurality of hardened metal roller means, and means for mounting said roller means to said body for free rotation about second axes, fixed with respect to said body, so that said roller means will impact upon and roll with respect to a sheet metal flange or the like, said roller means mounting means comprising a shaft for each roller means disposed so that each said second axis makes a positive angle between 0° and 90° with respect to said first axis of rotation.

2. A tool as recited in claim 1 wherein said angle $\alpha$ is about 35° to 55°.

3. A tool as recited in claim 1 or 2 wherein said shafts are disposed along lines converging at the interface between said guide component and said body.

4. A tool as recited in claim 1 wherein each shaft comprises a dowel pin that is releasably attached to said body.

5. A tool as recited in claim 1 wherein said roller means each comprises a tapered roller having flattened end portions received within a depression defined in said body, and having a peripheral portion extending exteriorly of said body.

6. A tool as recited in claim 5 wherein said plurality of roller means comprises three rollers disposed at the apices of an equilateral triangle, around the circumference of the body.

7. A tool as recited in claim 1 wherein said attaching means comprises means defining a screw-threaded bore concentric with the first axis in the body end opposite the guide component.

8. A metal-working hand tool for folding over sheet metal flanges, comprising a body adapted to rotate a body first axis of rotation;

means for attaching said body to a power source for rotating said body about the first axis of rotation;

a guide component extending from one end of said body;

said attaching means comprising means to finding a screw-threaded bore concentric with the first axis in the body and opposite the guide component;

said guide component comprising a guide pin, said guide pin having a head portion abutting an axial termination of the screw-threaded bore;

a plurality of hardened metal roller means; and means for mounting said roller means to said body for free rotation about second axes, fixed with respect to said body, so that said roller means will impact upon and roll with respect to a sheet metal flange or the like.

9. A method of deforming an upturned sheet metal elongated flange of a metal joint to close the joint, utilizing a powered metal-working hand tool including a body adapted to rotate about a first axis of rotation and having a guide component extending outwardly from the body generally along the axis of rotation, and a plurality of hardened metal roller means each mounted for rotation with the body about second axes not coincident with the first axis, said method comprising the steps of disposing the metal joint so that the metal flange extends generally vertically, effecting energization of the tool to rotate the body, disposing the guide component so that it is in a direction generally parallel to the metal flange, and moving the guide component into contact with a side of the joint while moving the tool generally horizontally along the direction of elongation of the flange, so that the roller means impact upon and roll with respect to the flange to deform it so that it extends generally horizontally.

10. A method-working hand tool for folding over sheet metal flanges, comprising a body adapted to rotate about a first axis of rotation, means for attaching said body to a power source for rotating said body about the first axis of rotation, a guide component extending outwardly from one end of said body generally along the first axis of rotation, a plurality of hardened metal roller means, and means for mounting said roller means to said body for free rotation about second axes, fixed with respect to said body, so that said roller means will impact upon and roll with respect to a sheet metal flange or the like, said roller means mounting means comprising a shaft for each roller means disposed so that each said second axis makes a positive angle $\alpha$ about 35° to 55° with respect to said first axis of rotation.

* * * * *